US008657647B2

(12) United States Patent
Baudimont et al.

(10) Patent No.: US 8,657,647 B2
(45) Date of Patent: Feb. 25, 2014

(54) METHOD OF POLISHING BLADED DISKS FOR A TURBOMACHINE AND POLISHING DEVICE

(75) Inventors: Cyrille Baudimont, Montlhery (FR); Jean-Francois Laurent Chabot, Melun (FR)

(73) Assignee: SNECMA, Paris (FR)

( * ) Notice: Subject to any disclaimer, the term of this patent is extended or adjusted under 35 U.S.C. 154(b) by 247 days.

(21) Appl. No.: 13/059,315

(22) PCT Filed: Aug. 26, 2009

(86) PCT No.: PCT/EP2009/061004

§ 371 (c)(1),
(2), (4) Date: Jul. 6, 2011

(87) PCT Pub. No.: WO2010/023226

PCT Pub. Date: Mar. 4, 2010

(65) Prior Publication Data

US 2011/0256809 A1 Oct. 20, 2011

(30) Foreign Application Priority Data

Aug. 29, 2008 (FR) ..... 08 55808

(51) Int. Cl.
*B24B 31/00* (2006.01)

(52) U.S. Cl.
USPC ..... 451/8; 451/113; 451/36

(58) Field of Classification Search
USPC ..... 451/113, 106, 104, 36, 37, 8
See application file for complete search history.

(56) References Cited

U.S. PATENT DOCUMENTS

| | | | | |
|---|---|---|---|---|
| 101,431 | A * | 4/1870 | Chambers, Jr. et al. | 451/113 |
| 2,547,056 | A | 4/1951 | Stieglitz | |
| 5,341,602 | A * | 8/1994 | Foley | 451/64 |
| 6,572,458 | B2 * | 6/2003 | Lim | 451/113 |
| 7,938,716 | B2 * | 5/2011 | Tzeng et al. | 451/36 |
| 2002/0016141 | A1 | 2/2002 | Lim | |
| 2006/0246825 | A1 | 11/2006 | Bolz et al. | |
| 2007/0107217 | A1 | 5/2007 | Baus et al. | |

FOREIGN PATENT DOCUMENTS

| | | | |
|---|---|---|---|
| CN | 1066616 | A | 12/1992 |
| EP | 1 177 857 | A2 | 2/2002 |
| EP | 1 177 857 | A3 | 2/2002 |
| EP | 1 731 262 | A1 | 12/2006 |
| JP | 57-211469 | | 12/1982 |
| JP | 63-109973 | | 5/1988 |
| RU | 2 113 969 | | 6/1998 |

OTHER PUBLICATIONS

Combined Chinese Office Action and Search Report issued Jan. 14, 2013, in Patent Application No. 200980133943.9 (with English-language translation).

(Continued)

*Primary Examiner* — Robert Rose
(74) *Attorney, Agent, or Firm* — Oblon, Spivak, McClelland, Maier & Neustadt, L.L.P.

(57) ABSTRACT

A device for polishing centrifugal impellers for a turbomachine including a vat configured to be filled with a polishing agent, and an impeller support configured to make the impeller rotate around its axis and move it along its axis such that all of points of the impeller have a helical movement whereof the pitch is close to that of the helix from which the general shape of the airflow channels of the impeller comes, delimited by the blades of the impeller.

16 Claims, 2 Drawing Sheets

(56) References Cited

OTHER PUBLICATIONS

Decision on Grant in Russian Patent Application No. 2011 111393/02 (w/English translation).

Preliminary Search Report issued Apr. 16, 2009 in French Patent Application No. FR 0855808 FA 713844 (with English translation of category of cited documents).

* cited by examiner

METHOD OF POLISHING BLADED DISKS FOR A TURBOMACHINE AND POLISHING DEVICE

TECHNICAL FIELD AND BACKGROUND OF THE INVENTION

The present invention relates primarily to a method for polishing bladed disks and comprising an airflow channel for a turbomachine, more particularly a method for polishing centrifugal impellers for a turbomachine compressor and single-piece bladed disks, and a polishing device for implementing such a method.

Turbomachines traditionally comprise a compressor, a compression chamber and a turbine.

The compressor is intended to increase the pressure of the atmospheric air, the combustion chamber mixes the air that is compressed by the compressor with fuel and burns the mixture, and the turbine, placed in the discharged flow, is driven by that flow of very hot air. It serves to drive the compressor via the axis of the turbomachine.

The compressor comprises rotors, said rotors comprising bladed disks, some of which are called centrifugal impellers, and stators. A centrifugal compressor impeller, hereinafter called impeller, comprises a substantially tapered body and blades distributed over the entire surface of the body.

These blades delimit, two by two with the tapered body, an air flow channel in the form of a helix portion.

A centrifugal compressor impeller therefore has a complex shape.

This impeller is, for certain applications, cut directly in the mass, for example in a block of titanium or nickel alloy. Such an impeller can also be obtained by casting, by rapid prototyping or electrochemically.

Moreover, due to the aerodynamic function the centrifugal compressor impellers must perform, the surface condition of the impeller, more particularly the surface of the tapered body forming the bottom of the channel along which the air flows, and that of the blades, is very important and very particular care is given to the production thereof.

To meet the aerodynamic conditions of the air flowing on the impeller, the surface parameter Ra must not exceed 0.6 μm (Ra is a statistical value and corresponds to the mean arithmetic deviation relative to the center line; Rt is the maximum height of the peaks). However, this roughness value cannot be obtained directly by machining, casting or another technique for making the impeller. A polishing step is therefore necessary in order to achieve the required surface quality.

There are several techniques for polishing such parts.

The polishing can be done manually using abrasive belts. This technique has the advantage of making it possible to polish pieces with complex shapes. However, this polishing takes a very long time, and is therefore costly in terms of labor. Moreover, its quality depends entirely on the operator performing the polishing.

Machines, like those described in U.S. Pat. No. 2,547,056, can be used, but they are very complex structures and do not make it possible to polish parts with complex shapes.

Polishing can also be done using abrasive particles, as described in document JP 57211469. This technique provides for mounting a cover on the impeller so as to enclose the active zone of the impeller comprising the blades in a closed space and placing abrasive particles in that volume, then making the impeller rotate around its horizontal axis. The rotation and gravity force cause the particles to move on the surface to be polished. When the required surface state is reached, the rotation of the impeller is interrupted, the cover and the particles are removed. With this technique, there is a risk of not achieving the desired surface parameter Ra due to stagnation of the abrasive particles in the zones in question.

It is therefore one aim of the present invention to propose a method for polishing centrifugal impellers, and more generally bladed turbomachine parts, that is simple, adapted to all types of impellers regardless of the complexity of their shapes, and offering a particularly high-performance surface state for the flow of air.

It is also an aim of the present invention to propose a device for polishing bladed disks that is simple and robust.

BRIEF DESCRIPTION OF THE INVENTION

The aim of the present invention is achieved through a polishing method using at least one polishing agent in which it is provided to move the impeller, or more generally the bladed disk comprising blades defining airflow channels formed by a helix portion, following a helical movement having a pitch close to the pitch of the helix.

Two blades of the impeller delimit an airflow channels; said airflow channels substantially has the profile of a conical helix portion. The term "pitch of the helix of the impeller" then refers to the pitch of the helix formed by the airflow channels. All the airflow channels delimited by two successive blades have substantially the same helical profile.

According to the invention, the impeller is moved in translation and rotation so as to reproduce the helix portion described by the airflow channels. The speeds of rotation and translation are then adapted so that any point of the impeller has a movement whereof the trajectory is close to the helix of the impeller.

Thus the movement of the polishing agent relative to the blading is substantially that of the flow of the air between the blades, which improves the performance of the method.

Advantageously, the method according to the invention provides for applying an alternating movement, the blading is then moved in a first direction of rotation and a first direction of translation, then is moved in a second direction of rotation opposite the first direction of rotation and in a second direction of translation opposite the first direction of translation, these two combinations of movements being reproduced alternatively.

The present invention then primarily relates to a method for polishing a bladed disk, the blading comprising a plurality of blades defining, two by two, an airflow channel substantially having a general profile in the shape of a helix portion with pitch p, said disk being submerged in a bed of polishing agent, said method comprising at least:

- a step A for moving said disk in a first direction of rotation around the longitudinal axis of the disk and in a first direction of translation along said longitudinal axis simultaneously, such that the travel of each of the points of said disk is at least a portion of a helix whereof the pitch is close to the pitch p of the helix from which the general shape of the airflow channels comes.

The method according to the invention can also comprise at least:

- a step B after step A for rotational movement around the longitudinal axis of the disk in a second direction opposite the first direction and translational movement along said longitudinal axis in a second direction opposite the first direction simultaneously such that all of the points of the disk respectively pass through the same helixes as in step A, but in the opposite direction.

Particularly advantageously, steps A and B are repeated alternatively.

The speed of rotation of the impeller and the speed of translation of the impeller are advantageously connected by a proportionality factor calculated as a function of the tangent of the helix portion from which the general shape of the airflow channels comes.

The method according to the invention can comprise a step C, before step A, for determining the static pressure to be applied to the disk and placing a given quantity of polishing agent as a function of the static pressure previously determined above said disk.

The polishing agent can be formed by solid abrasive particles, with shapes suitable for circulating between the bladings of the impeller.

Advantageously, the polishing agent can be mixed with water, with an acid adapted to the material to be polished, or be mixed with a medium so as to form a paste.

The polishing method is advantageously applicable to centrifugal compressor impellers for a turbomachine compressor.

The present invention also relates to a polishing device comprising a vat intended to be filled with a polishing agent, a bladed disk support, the blading comprising a plurality of blades defining, two by two, an airflow channel substantially having a general profile in the form of a helix portion with pitch p, and driving means able to drive the support in rotation around its longitudinal axis and in translation along said longitudinal axis simultaneously, the driving means being programmed so as to make at least a portion of the helix, the pitch of which is close to the pitch p from which the general shape of the airflow channels of the disk to be polished comes, travel to each point of the support.

The support can comprise a shaft with a longitudinal axis on which the disk to be polished is intended to be fixed coaxially and wherein the vat comprises a bottom provided with an opening passed through by said shaft of the support, the device also comprising sealing means between the bottom of the vat and the disk.

The sealing means advantageously comprise a tube able to slide in said opening in the longitudinal direction sealably, a plate on which the disk is intended to be mounted, said plate being fixed on a longitudinal end of the tube penetrating the vat, said tube having an outer diameter substantially equal to the outer diameter of the portion of the disk bearing on the tube and the diameter of the opening formed in the vat.

Particularly advantageously, the face of the plate intended to be in contact with the disk comprises an annular slot receiving a sealing device intended to come into contact with the disk and prevent the polishing agent from penetrating between the disk and the plate.

The device according to the invention can comprise means for maintaining the disk on the support, said disk being intended to be maintained by gripping between a platen fixed on a free end of the shaft of the support and the plate.

The device according to the invention advantageously comprises a sealing device between the vat and the tube, of the O-ring or lip seal type.

Advantageously, the diameter of the tube is substantially equal to the diameter of the disk on its trailing edge side.

The driving means comprise, for example, a first motor intended to drive the support in rotation around its longitudinal axis and a second motor intended to drive the support in translation along said longitudinal axis, the first motor being able to drive the support in rotation in a first direction and in a second direction opposite the first direction alternatively, and the second motor being able to drive the support in translation in a first direction of translation and in a second direction of translation opposite the first, alternatively.

The polishing device according to the invention is advantageously used to polish a centrifugal compressor impeller of a turbomachine compressor.

BRIEF DESCRIPTION OF THE DRAWINGS

The present invention will be better understood using the following description and the appended drawings, in which.

DETAILED DESCRIPTION OF THE INVENTION

In the continuation of the description, we will apply the polishing method to a centrifugal compressor impeller of a turbomachine compressor, but the present invention is applicable to any bladed part, such as a single-piece bladed disk used in a turbine.

Figure 1:
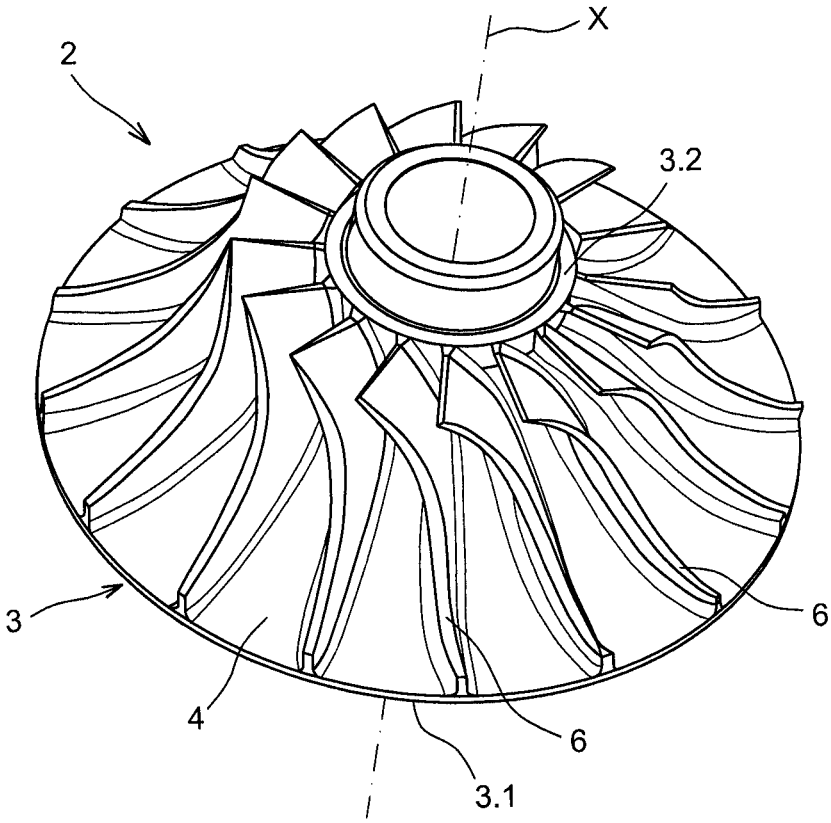
FIG. 1 is a perspective view of a centrifugal compressor impeller to which the invention can be applied.

FIG. 1 shows an example of a centrifugal impeller 2 of a compressor to which the invention is applied.

A centrifugal compressor impeller is a part rotationally mobile around the longitudinal axis of the turbomachine and is driven by the turbine.

The impeller 2 comprises a substantially annular flange 3 with axis X. The flange 3 comprises, at a first longitudinal end, a large base 3.1 with a larger diameter and, at a second longitudinal end, a small base 3.2 with a smaller diameter, the larger diameter and the smaller diameter being connected by a concave annular surface 4 called a channel.

The impeller 2 also comprises blades 6 protruding from the concave annular surface 4. The blades 6 are regularly distributed over the entire outer periphery of the flange 3, and extend from the small base 3.2 of the flange to the large base 3.1 of the flange 3, and connect to the flange via spokes.

The ends 6.1 of the blades on the small base 3.2 side form the leading edges, and the ends of the large base side 3.1 form the trailing edges.

Each blade 6 has, from above, approximately the shape of a helix portion. All of the blades are substantially identical and therefore come from a same helix portion with pitch p.

The blades delimit, two by two, airflow channels wherein the air to be compressed circulates from the leading edge towards the trailing edge. The airflow channels therefore have a general profile in the form of a helix portion substantially identical to that of the blades 6.

The impeller can be made by machining a block of metal, for example titanium. At the end of the machining step, the surface of the impeller is faceted and is unacceptable in that condition. It can also be made directly by casting, rapid prototyping, or an electrochemical method.

This impeller then undergoes a polishing step, in a known manner.

The present invention proposes a polishing method that is easy to carry out and a robust device for polishing such an impeller, also offering improved aerodynamic properties for the impeller.

Figure 2:
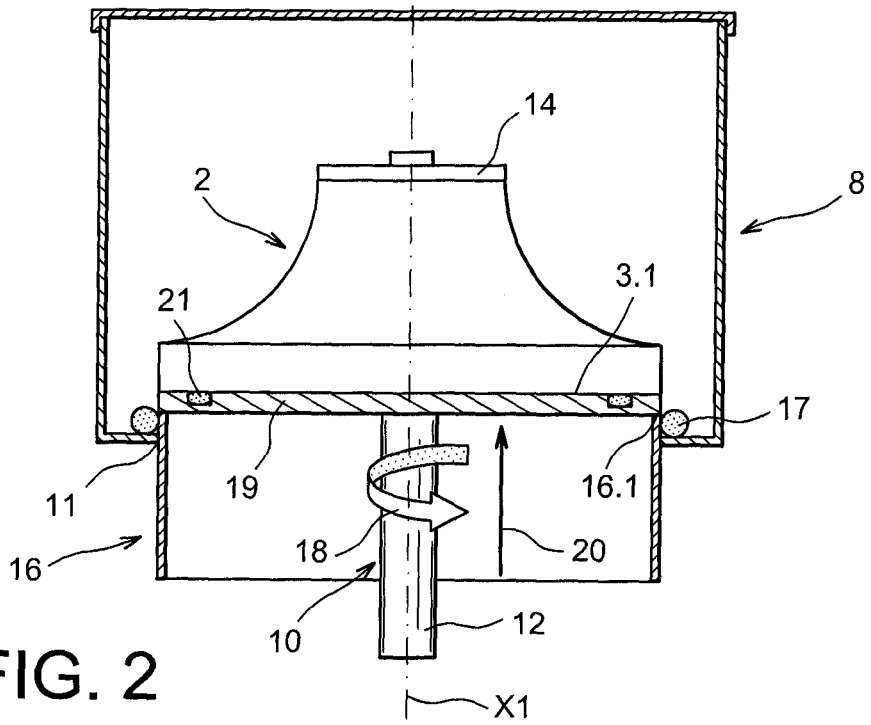
FIG. 2 is a diagrammatic cross-sectional illustration of a polishing device according to the present invention, the impeller being in place.
Figure 3:
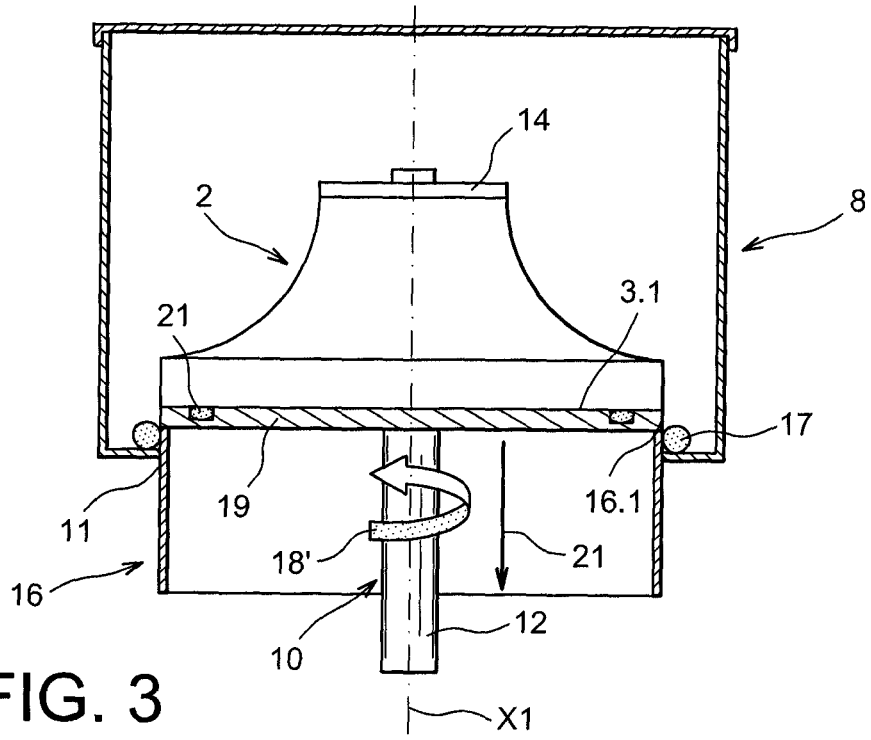
FIG. 3 is an illustration of the polishing device of FIG. 2, the polishing device being in a different state, the impeller being in place.

FIGS. 2 and 3 show an embodiment of a polishing device according to the present invention comprising a vat 8 intended to contain a polishing agent. The impeller 2 is shown diagrammatically.

The polishing agent is formed at least in part by solid abrasive particles. The polishing agent can be contained in a paste or mixed with a fluid, such as water. The particles forming the polishing agent can be made up of aluminum oxide, silicon carbide, boron carbide . . . . This list is not exhaustive, the material of the particles being chosen as a function of the material of the piece to be polished. The size of these particles is also chosen as a function of the surface condition to be achieved. The abrasive particles can be combined with a chemical abrasive, such as an acid.

According to the present invention, the polishing device also comprises a movable support 10 able to move the impeller 2 in rotation around an axis X1 and in translation along the axis X1 in the vat 8.

According to the present invention, the movement of the support in the vat is controlled so that any point thereof moves according to a helix with a pitch identical, or at least close, to the pitch p of that from which the blades of the impeller come.

To that end, the polishing device comprises driving means (not shown) for the support intended to simultaneously apply a rotational movement and a translational movement to the support 10, each movement having a speed determined so as to reproduce the pitch p of the helix.

Advantageously, the driving means can move the support 10 so that any point thereof goes through a helix with a given pitch in a direction, for example from bottom to top, then travels through the same helix in an opposite direction, i.e. from top to bottom. Thus, the support has an alternating movement, and moves upward, then downward, alternatively. The polishing agent between the blades 6 then has a back-and-forth movement relative to the helical impeller with pitch p. This back-and-forth movement also makes it possible to have a more compact device, since the movement travel of the disk can be reduced.

The driving means can move the support 10 over less than one helix pitch, one helix pitch or more than one helix pitch.

As a result, by fixing an impeller 2 on the support so that the axis X of the impeller 2 is coaxial to the axis X1 of rotation of the support, the polishing agent will move between the blades 6 while substantially reproducing the airflow lines in the airflow channels. The polishing therefore occurs directionally and improves the aerodynamic performance of the impeller 2.

More particularly, the device as shown comprises an opening 11 in the bottom of the vat 8 for the passage of the support 10. The support 10 is formed by a shaft 12 with axis X1 around which the impeller 2 is mounted, driven by the driving means. The support 10 comprises means for fixedly securing the impeller 2 on a free end (not visible) of the shaft 12 situated in the vat 8. These securing means are, for example, formed by a gripping system sandwiching a central portion of the impeller 2 not requiring polishing by the device according to the invention.

A platen 14, covering the central bore of the impeller 2, is provided and is part of the gripping system. The platen 14 is for example maintained using a bolt screwed into the shaft 12.

Sealing is also provided between the support 10 and the vat 8, more particularly between the support 10 and the opening 11.

In the illustrated embodiment, the rod 12 is topped by a plate 19 serving to support the impeller 2, on which the large base 3.1 of the impeller rests. A tube 16 with an outer diameter substantially equal to the outer diameter of the impeller on the trailing edge side is fixed, by a longitudinal end 16.1, on the plate 19, for example by welding, the plate 19 then forms the bottom of the tube 16. The diameter of the opening 11 is substantially equal to the outer diameter of the tube 16 in order to ensure sliding contact between the tube 16 and the periphery of the opening 11.

The plate 19 comprises, at its outer periphery, an annular groove in which a joint 21 is positioned. This joint 21 ensures the sealing between the plate 19 and the impeller 2 in order to prevent particles or fluid, for example an acid, from coming between the impeller and the plate.

The tube 16 can move at least in translation along the axis X1 in order to follow the impeller 2 and remain in contact with it.

A sealing device 17, of the O-ring or lip seal type, is also provided to confirm the sealing between the tube 16 and the bottom of the vat 8.

In one alternative embodiment, it could be provided for the impeller to rest directly on the longitudinal end 16.1 of the tube 16, the sealing between the tube 16 and the impeller 2 then being obtained by a simple metal/metal contact or by an additional joint. Advantageously, the tube 16 does not move relative to the impeller 2, i.e. it moves following a movement identical to that of the impeller 2 in order to prevent any relative displacement between the tube 16 and the impeller 2, thereby improving the sealing between the tube 16 and the impeller 2, and prevents wear of the tube 16 and/or the impeller 2. It is also possible to provide for fixing the tube on the impeller, or securing the tube to the mobile support 10 in rotation and translation.

The impeller is held advantageously, by gripping it between the platen 14 and the plate 19.

The impeller 2 is submerged in a bed of polishing agent (not shown). In this embodiment, the abrasive particles are arranged above the surface to be polished, the static pressure of the abrasive particles on the impeller 2 is therefore directly proportional to the height of particles above the impeller 2, which corresponds to the average submersion distance of the impeller 2 in the vat 8.

The abrasive particles are such that they behave like a fluid.

It is then possible to vary the effectiveness of the polishing, and therefore the time required to obtain the desired surface state by simply modifying the quantity of particles in the vat, more precisely the particle height. No specific means for exerting additional pressure on the particles is then necessary. The pressure adjustment is only done mechanically by choosing the height of the polishing agent. This device is very simple and does not require any particular monitoring means. It is therefore very robust. However, such a means, of the piston type, exerting an axial force towards the bottom of the vat, could be considered.

Moreover, the relative speed between the polishing agent and the impeller depends directly on the speed of rotation of the impeller 2, and therefore the speed of displacement of the support 10. As a result, it is possible to vary the polishing time of the impeller 2 by varying the displacement speed of the support 10.

The driving means comprise a first motor intended to drive the support in rotation and a second motor intended to drive the support 10 in translation along the axis X.

As an example, the displacement speed of the particles relative to the impeller can be between 2 m/min and 20 m/min; the polishing time can then be between 10 min and 5 hours. It should be noted that these are estimated speeds. In general, the parameters are adjusted after experimentation to find the best compromise between treatment time, preservation of the part, and the surface parameter Ra obtained.

The speeds of translation and rotation are linked by a proportionality factor that is obtained from the value of the tangent of the helix of the impeller. The rotation and translation speeds therefore vary during the movement because the tangent of the helix varies, but a constant proportionality can also be provided between the two speeds. It is recalled that the bottom of the channel of the impeller has a concave annular surface.

We will now describe the polishing steps using a polishing device according to the present invention.

In FIG. 2, the polishing device according to the present invention is in the low position, which corresponds to the idle position.

During a first step, the impeller 2 is fixed on the support 10; to that end the impeller 2 is mounted around the shaft 12 of the support 10, which passes through the central bore of the impeller, the impeller 2 and the support 10 then being coaxial and immobile in movement relative to each other.

The impeller 2 then bears on the plate 19. The platen 14 is then fixed on the upper end of the shaft 12 of the support 10 and keeps the impeller gripped between the plate 19 and the platen 14.

The polishing agent is then placed in the vat 8, the quantity of polishing agent, more particularly the height of the polishing agent covering the impeller 2, is determined as a function of the polishing one wishes to perform, in particular the duration thereof.

The driving means are then launched, their control having been programmed as a function of the pitch of the helix of the blades 6 of the impeller 2 to be reproduced. The first and second motors then drive the support 10 in rotation and translation, respectively, which moves the impeller 2 in the vat 8 filled with polishing agent, the tube 16 sliding sealably through the bottom of the vat 8, as shown in FIG. 2.

The speed of rotation of the support and the time during which the impeller is polished are preferably determined as a function of the level of polishing required, these characteristics generally being determined by experimentation.

The impeller is then moved in rotation and translation, in the illustrated example it rotates counterclockwise (arrow 18) and moves upward (arrow 20). All of the points of the impeller 2 therefore travel over virtual helixes with pitch p from bottom to top, until they reach a high position illustrated in FIG. 3.

Then, the control of the first and second motors is reversed, the impeller rotates clockwise (arrow 18' in FIG. 2) and moves in translation from top to bottom (arrow 21), all of the points of the impeller travel over the same helixes but from top to bottom.

As a result, the direction of relative displacement of the polishing agent and the impeller, more particularly of the parts delimiting the airflow channels, is substantially the same as that which the air will travel over in the impeller when it equips the compressor.

In the illustrated example, the impeller 2 penetrates the vat 8 by a lower end of the vat 8, but it could be provided for the impeller to penetrate the vat via its upper end and to move towards the lower end of the vat. In that case, the pressure exerted by the particles would not be simply the static pressure proportional to the particle height, but would be that applied by the support in an axial direction oriented towards the bottom of the vat. As a result, the control of this pressure would be more complex than in the illustrated example.

It can also be provided to impart a movement to the polishing agents, e.g. a vibrational movement; to that end means can be provided capable of making the vat vibrate.

The method according to the present invention makes it possible to polish any type of impeller, regardless of the dimensions thereof.

Furthermore, the polishing according to the inventive method can be easily automated, and does not require human intervention during polishing. It is also simple and robust.

Moreover, this method applies to all materials by choosing the suitable abrasive.

The invention claimed is:

1. A method for polishing a bladed disk, the bladed disk including a plurality of blades defining, two by two, an airflow channel substantially having a general profile in a form of a helix portion with pitch p, the disk being submerged in a bed of polishing agent, the method comprising:

a) moving the disk in a first direction of rotation around the longitudinal axis of the disk and in a first direction of translation along the longitudinal axis simultaneously, such that a travel of each of points of the disk is at least a portion of a helix, whereof the pitch is close to the pitch p of the helix from which the general shape of the airflow channels comes.

2. The polishing method according to claim 1, further comprising:

b) after the moving a) rotational movement around the longitudinal axis of the disk in a second direction opposite the first direction and translational movement along the longitudinal axis in a second direction opposite the first direction simultaneously such that all of the points of the disk respectively pass through same helixes as in the moving a), but in the opposite direction.

3. The polishing method according to claim 2, wherein the moving a) and rotational movement b) are repeated alternatively.

4. The polishing method according to claim 1, wherein a speed of rotation of an impeller and a speed of translation of the impeller are linked by a proportionality factor calculated as a function of a tangent of the helix portion from which the general shape of the airflow channels comes.

5. The polishing method according to claim 1, further comprising, before the moving a), c) determining static pressure to be applied to the disk and placing a given quantity of polishing agent as a function of the determined static pressure above the disk.

6. The polishing method according to claim 1, wherein the polishing agent comprises at least solid abrasive particles, with shapes configured for circulating between blades of an impeller.

7. The polishing method according to claim 1, wherein the polishing agent is mixed with water, with an acid adapted to a material to be polished, or is mixed with a medium so as to form a paste.

8. The polishing method according to claim 1, the bladed disk being a centrifugal compressor impeller for a turbomachine compressor.

9. A polishing device comprising:

a vat configured to be filled with a polishing agent;

a bladed disk having a support and comprising a plurality of blades defining, two by two, an airflow channel substantially having a general profile in a form of a helix portion with pitch p; and driving means for driving the support in rotation around its longitudinal axis and in translation along the longitudinal axis simultaneously, so as to make at least a portion of the helix, the pitch of which is close to the pitch p from which the general shape of the airflow channels of the disk to be polished comes, travel to each point of the support wherein the support comprises a shaft with a longitudinal axis on which the disk to be polished is configured to be fixed coaxially, and wherein the vat comprises a bottom comprising an opening passed through by the shaft of the support, the device further comprising a sealing device between the bottom of the vat and the disk.

10. The polishing device according to claim 9, wherein the sealing device comprises a tube configured to slide in the opening in the longitudinal direction sealably, a plate on which the disk is configured to be mounted, the plate being fixed on a longitudinal end of the tube penetrating the vat, the tube having an outer diameter substantially equal to an outer diameter of the portion of the disk bearing on the tube and a diameter of the opening formed in the vat.

11. The polishing device according to claim 10, wherein a face of the plate configured to be in contact with the disk comprises an annular groove receiving a sealing device configured to come into contact with the disk and prevent the polishing agent from penetrating between the disk and the plate.

12. The device according to claim 10, further comprising means for maintaining the disk on the support, the disk configured to be maintained by gripping between a platen fixed on a free end of the shaft of the support and the plate.

13. The polishing device according to claim 10, further comprising a sealing device between the vat and the tube, of O-ring or lip seal type.

14. The device according to claim 10, wherein the diameter of the tube is substantially equal to the diameter of the disk on its trailing edge side.

15. The polishing device according to claims 9, wherein the driving means comprises a first motor configured to drive the support in rotation around its longitudinal axis and a second motor configured to drive the support in translation along the longitudinal axis, the first motor configured to drive the support in rotation in a first direction and in a second direction opposite the first direction alternatively, and the second motor configured to drive the support in translation in a first direction of translation and in a second direction of translation opposite the first, alternatively.

16. The polishing device according to claim 9, the bladed disk being a centrifugal compressor impeller of a turbomachine compressor.

* * * * *